US007319298B2

(12) United States Patent
Jungwirth et al.

(10) Patent No.: US 7,319,298 B2
(45) Date of Patent: Jan. 15, 2008

(54) DIGITALLY CONTROLLED LUMINAIRE SYSTEM

(75) Inventors: Paul Jungwirth, Burnaby (CA); Shane P. Robinson, Gibsons (CA); Ingo Speier, Saanichton (CA); Ian Ashdown, West Vancouver (CA)

(73) Assignee: Tir Systems, Ltd., Burnaby (CA)

( * ) Notice: Subject to any disclaimer, the term of this patent is extended or adjusted under 35 U.S.C. 154(b) by 0 days.

(21) Appl. No.: 11/314,190

(22) Filed: Dec. 21, 2005

(65) Prior Publication Data

US 2007/0040512 A1 Feb. 22, 2007

Related U.S. Application Data

(60) Provisional application No. 60/709,217, filed on Aug. 17, 2005.

(51) Int. Cl.
*G05F 1/00* (2006.01)

(52) U.S. Cl. ..... 315/307; 315/308; 315/224; 315/149; 315/312; 315/360; 362/227; 362/234; 362/800; 250/216; 250/226

(58) Field of Classification Search ..... 315/307, 315/308, 291, 224, 149, 159, 312, 362, 169.3, 315/118, 360; 362/234, 253, 800, 276, 227; 250/226, 216, 205, 214 C, 214 AL
See application file for complete search history.

(56) References Cited

U.S. PATENT DOCUMENTS

| | | | | |
|---|---|---|---|---|
| 6,127,784 | A | 10/2000 | Grossman et al. | 315/159 |
| 6,411,046 | B1 | 6/2002 | Muthu | 315/309 |
| 6,441,558 | B1 * | 8/2002 | Muthu et al. | 315/149 |
| 6,448,550 | B1 * | 9/2002 | Nishimura | 250/226 |

(Continued)

OTHER PUBLICATIONS

Dyble et al., "Impact of Dimming White LEDs: Chromaticity Shifts Due to Different Dimming Methods", *Fifth International Conference on Solid State Lighting, Preceedings of SPIE* 5941:291-299 (2005).

*Primary Examiner*—Haissa Philogene
(74) *Attorney, Agent, or Firm*—Pillsbury Wintrhop Shaw Pittman LLP

(57) ABSTRACT

The present invention provides a luminaire system capable of generating light of a desired chromaticity and luminous flux output during continuous operation with varying ambient operating temperature. The luminaire system can be further capable of maintaining a desired correlated colour temperature during dimming of the luminaire. The luminaire system comprises one or more arrays of light-emitting elements for generating light with a current driver system coupled thereto for selectively supplying electrical drive current to each of the arrays, wherein the current driver system is responsive to drive signals received from a controller. The luminaire system further comprises an optical sensor system for generating optical signals representative of chromaticity and luminous flux output of the light. A heat sensing system is operatively coupled to the one or more arrays for generating signals representative of the junction temperatures of arrays of light-emitting elements during operation. The luminaire system further comprises a controller that is operatively connected to the current driver system, the optical sensor system and the heat sensing system for receiving the signals generated by each of these systems and is configured to generate one or more drive signals for transmission to the current driver system in response to the optical signals and thermal signals received from the optical system and the heat sensing system, respectively, thereby enabling a desired level of control of the output light.

29 Claims, 3 Drawing Sheets

U.S. PATENT DOCUMENTS 6,495,964 B1 12/2002 Muth et al.
6,507,159 B2 * 1/2003 Muthu ..... 315/307
6,576,881 B2 * 6/2003 Muthu et al. ..... 250/205
6,630,801 B2 * 10/2003 Schuurmans ..... 315/307
6,753,661 B2 * 6/2004 Muthu et al. ..... 315/307
7,140,752 B2 * 11/2006 Ashdown ..... 362/276
2006/0245174 A1 * 11/2006 Ashdown et al. ..... 362/85

* cited by examiner

DIGITALLY CONTROLLED LUMINAIRE SYSTEM

This application claims priority from now expired U.S. Provisional Patent Application No. 60/709,217 filed Aug. 17, 2005.

FIELD OF THE INVENTION

The present invention pertains to luminaires, and particularly to a luminaire system capable of maintaining desired lighting conditions, for example constant colour temperature, during operation.

BACKGROUND

Recent technological advancements in light-emitting diode (LED) design have been a boon to the lighting industry. With their high overall luminous efficacy and flexibility for achieving various light patterns, LED-based luminaires are increasingly being used in signage, advertising, display lighting, and backlit lighting applications. LED-based luminaires are also replacing the traditional incandescent or fluorescent lighting fixtures to become the mainstream lighting architecture.

Due to its natural lighting characteristics, white light is the preferred choice for lighting. An important consideration for LED-based luminaires used for ambient lighting is the need to produce natural white light. White light can be generated by mixing the light emitted from different colour LEDs.

Various standards have been proposed to characterize the spectral content of light. One way to characterize light emitted by a test light source is to compare it with the light radiated by a black body and identify the temperature of the black body at which its perceived colour best matches the perceived colour of the test light source. That temperature is called correlated colour temperature (CCT) and is usually measured in Kelvin (K). The higher the CCT, the bluer, or cooler the light appears. The lower the CCT, the redder, or warmer the light appears. An incandescent light bulb has a CCT of approximately 2854 K, and fluorescent lamps can have CCTs in the range of approximately 3200 K to 6500 K.

Furthermore the properties of light can be characterized in terms of luminous flux and chromaticity. Luminous flux is used to define the measurable amount of light and chromaticity is used to define the perceived colour impression of light, irrespective of its perceived brightness. Chromaticity and luminous flux are measured in units according to standards of the Commission Internationale de l'Eclairage (CIE). The CIE chromaticity standards define hue and saturation of light based on chromaticity coordinates that specify a position in a chromaticity diagram. The chromaticity coordinates of light are derived from tristimulus values and expressed by the ratio of the tristimulus values to their sum; i.e. $x=X/(X+Y+Z)$, $y=Y/(X+Y+Z)$, $z=Z/(X+Y+Z)$, where x, y and z are the chromaticity coordinates and X, Y, and Z the tristimulus values. Because $x+y+z=1$, it is only necessary to specify two chromaticity coordinates such as x and y, for example. Any CCT value can be transformed into corresponding chromaticity coordinates.

In spite of their success, LED-based luminaires can be affected by a number of parameters in a complex way. Chromaticity and luminous flux output of LEDs can greatly depend on junction temperature and drive current as well as device aging effects that result in efficacy degradation over time, which can have undesirable effects on the CCT and more generally the chromaticity of the emitted light.

Ignoring temperature dependencies, the amount of light emitted by an LED is proportional to its instantaneous forward current. If the LEDs are pulsed at a rate greater than about 300 Hz, the human visual system perceives a time-averaged amount of light as opposed to individual pulses. As a result, luminaire dimming can be achieved by varying the amount of time-averaged forward current, using such techniques as pulse width modulation (PWM) or pulse code modulation (PCM). However, changes in the average forward current can affect the junction temperature of the LED, which can alter the spectral power distribution and in consequence the CCT or chromaticity and luminous flux of the light emitted by the LED. The compensation of this effect can become complex when various coloured LEDs are used to generate mixed light of a desired chromaticity. As discussed by M. Dyble, in "Impact of Dimming White LEDs: Chromaticity Shifts Due to Different Dimming Methods," Fifth International Conference on Solid State Lighting, Bellingham, Wash.; SPIE Vol. 5941, 2005, colour appearance of the resultant mixed light can shift unacceptably when dimming, as the spectral power distribution of the individual LEDs can change.

LED junction temperature variations can also cause undesired effects on the spectral power distribution of the resultant output light. Variations in junction temperature not only can reduce the luminous flux output, but can also cause undesirable variations in the CCT of the mixed light. Overheating can also reduce the life span of LEDs.

In order to overcome these limitations, various methods for generating natural white light have been proposed. U.S. Pat. No. 6,448,550 to Nishimura teaches a solid-state illumination device having a plurality of LEDs of different colours using optical feedback. Light from the LEDs is measured by photosensitive sensors mounted in close proximity with LEDs and compared with a reference set of responses to a previously measured spectral power distribution. The amount of variation between the sensor responses to the light from the LEDs and the previously measured spectral power distribution is used as a basis for adjusting the current to the LEDs in order to maintain the light from the LEDs as close as possible to the pre-determined spectral power distribution. While the Nishimura reference provides an effective way to achieve control of the spectral power distribution of the output light with any desired colour property, it does not consider maintaining colour stability over the life of the LEDs and at different operating conditions, including dimming.

U.S. Pat. No. 6,507,159 to Muthu discloses a control method and system for an LED-based luminaire having a plurality of red, green and blue light LEDs for generating a desired light by colour mixing. Muthu seeks to alleviate the unwanted variations in the luminous flux output and CCT of the desired light by providing a control system with a feedback system including filtered photodiodes, a mathematical transformation for determining tristimulus values of the LEDs, and a reference-tracking controller for resolving the difference between the feedback tristimulus values and the desired reference tristimulus values in order to adjust the forward current of the LEDs, such that the difference in tristimulus values is reduced to zero. The Muthu reference however does not provide a solution for alleviating the discrepancies in the colour temperature of the desired light that are caused by the shifting of peak wavelength of the LEDs over time. In addition, the calculations required for the mathematical transformation make it difficult to implement a feedback control system with a response time that is fast enough to avoid visual flicker during dimming operations, for example.

U.S. Pat. No. 6,576,881 to Muthu et al. discloses a method and system for controlling the output light generated by red, green, and blue LEDs. Sensors positioned proximate to the LEDs to detect a first set of approximate tristimulus values of the output light. The first set of tristimulus values is communicated to a controller, which converts these values into a second set of tristimulus values representative of a standard colourimetric system. The relative luminous flux output of the LEDs is adjusted on the basis of the difference between the second set of the tristimulus values and a set of user-specified tristimulus values. The Muthu et al. reference however does not account for shifting of the peak wavelength of the LEDs due to temperature, dimming, or age of the components. In addition, the calculations required for the mathematical transformation between the two sets of tristimulus values makes it difficult to implement a feedback control system with a response time that is fast enough to avoid visual flicker during dimming operations, for example.

U.S. Pat. No. 6,630,801 to Schuurmans provides a method and system for sensing the colour point of resultant light produced by mixing coloured light from a plurality of LEDs in the RGB colours. The system comprises a feedback unit for generating feedback values corresponding to the chromaticity of the resultant light based on values obtained from filtered and unfiltered photodiodes that are responsive to the light from the LEDs, as well as a controller which adjusts the resultant light based upon the difference between the feedback values and values representative of the chromaticity of a desired resultant light. However, the method disclosed by Schuurmans does not account for shifting of the peak wavelength of the LEDs due to temperature, dimming, or age of the components.

U.S. Patent Publication No. 2003/0230991 to Muthu et al. discloses an LED-based white-light backlighting system for electronic displays. The backlighting of Muthu et al. includes a plurality of LEDs of different light colours arranged such that the combination of light colours produces white light, and a microprocessor which monitors the luminous flux, radiant flux, or tristimulus levels of the white light and controls the luminous flux and chromaticity of the white light by feedback control. The backlighting of Muthu et al. uses photodiodes with filters to determine approximate tristimulus values of the LEDs and adjust the luminous flux and chromaticity of the white light. Temperature variations from heat sinks attached to LEDs is also measured and used to account for changes in the luminous flux and chromaticity of the LEDs. Muthu et al. however, fail to consider the junction temperature during dimming of the LEDs. Muthu et al. also fail to consider the effect of peak wavelength shift and photodiode inaccuracies on the white light produced.

U.S. Pat. No. 6,441,558 also to Muthu et al. discloses a multi-colour LED-based luminaire for generating various desired light at different colour temperatures. The desired luminous flux output for each array of colour LEDs is achieved by a controller system that adjusts the current supplied to the LEDs based on the chromaticity of the desired light and the junction temperature of the LEDs. One of the shortcomings associated with the LED-based luminaire of Muthu et al. is that in order to measure the luminous flux of an array of LEDs, an optical feedback sensor is used to obtain the luminous flux from the LEDs which is communicated to the controller by a polling sequence. According to Muthu et al., the measurement sequence begins by measuring the luminous flux output of the all LED arrays in operation. Each array of LEDs is alternately switched "OFF" briefly, and a further measurement is taken. The difference between the initial measurement and the next measurement provides the light output from the LED array that was turned off. The measurement of the light output is repeated for the remaining LED arrays. A drawback of this procedure as disclosed by Muthu et al. is the excessive amount of thermal stress imposed on the LEDs during ON and OFF cycles at low frequencies.

There is therefore a need for a system and method that can effectively maintain the chromaticity, colour temperature and luminous flux of a multi-colour LED-based luminaire, while alleviating the effects of device aging and junction temperature changes on the LEDs.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a digitally controlled luminaire system. In accordance with one aspect of the present invention there is provided a luminaires system for generating light of a desired chromaticity and luminous flux output, the luminaire system comprising: one or more arrays, each array comprising one or more light-emitting elements for generating light; a current driver system operatively coupled to the one or more arrays, the current driver system for selectively supplying electrical drive current to each of the one or more arrays, the current driver system being responsive to one or more drive signals; one or more optical sensor systems operatively coupled to the one or more light-emitting elements, each optical sensor system comprising one or more optical sensors for sensing a predetermined portion of the light generated by the light-emitting elements, each optical sensor system configured to generate optical signals representative of chromaticity and luminous flux output of the predetermined portion of the light; a heat sensing system operatively coupled to the one or more arrays, the heat sensing system comprising one or more thermal sensors for generating first signals representative of junction temperatures of each of the one or more arrays; and a controller operatively connected to the current driver system, the one or more optical sensor systems and the heat sensing system; the controller being configured to generate one or more drive signals in response to the optical signals relative to the desired chromaticity and luminous flux output, the controller further configured to modify the one or more drive signals in response to the first signals thereby compensating for temperature variations of the arrays; wherein the luminaire system is adapted for connection to a source of power.

In accordance with another aspect of the present invention there is provided in a luminaire system a method for controlling operation of light-emitting elements to generate light having a desired chromaticity and luminous flux output, the method comprising the steps of: providing drive currents to the light-emitting elements for generation of light; measuring optical signals representative of the light being generated by a optical sensing system; measuring temperature signals representative of junction temperature of the light-emitting elements; evaluating a first modification factor defined by a relationship between junction temperature and light emission characteristics of the light-emitting elements; determining new drive currents based on the measured optical signals and the first modification factor; providing the new drive current to the light-emitting elements; thereby controlling the operation of the light-emitting elements to generate light having a desired chromaticity and luminous flux output.

BRIEF DESCRIPTION OF THE FIGURES

A better understanding of the embodiments of the present invention can be obtained with reference to the following drawings which show by way of example embodiments of the present invention, in which.

DETAILED DESCRIPTION OF THE INVENTION

Definitions

Figure 1:
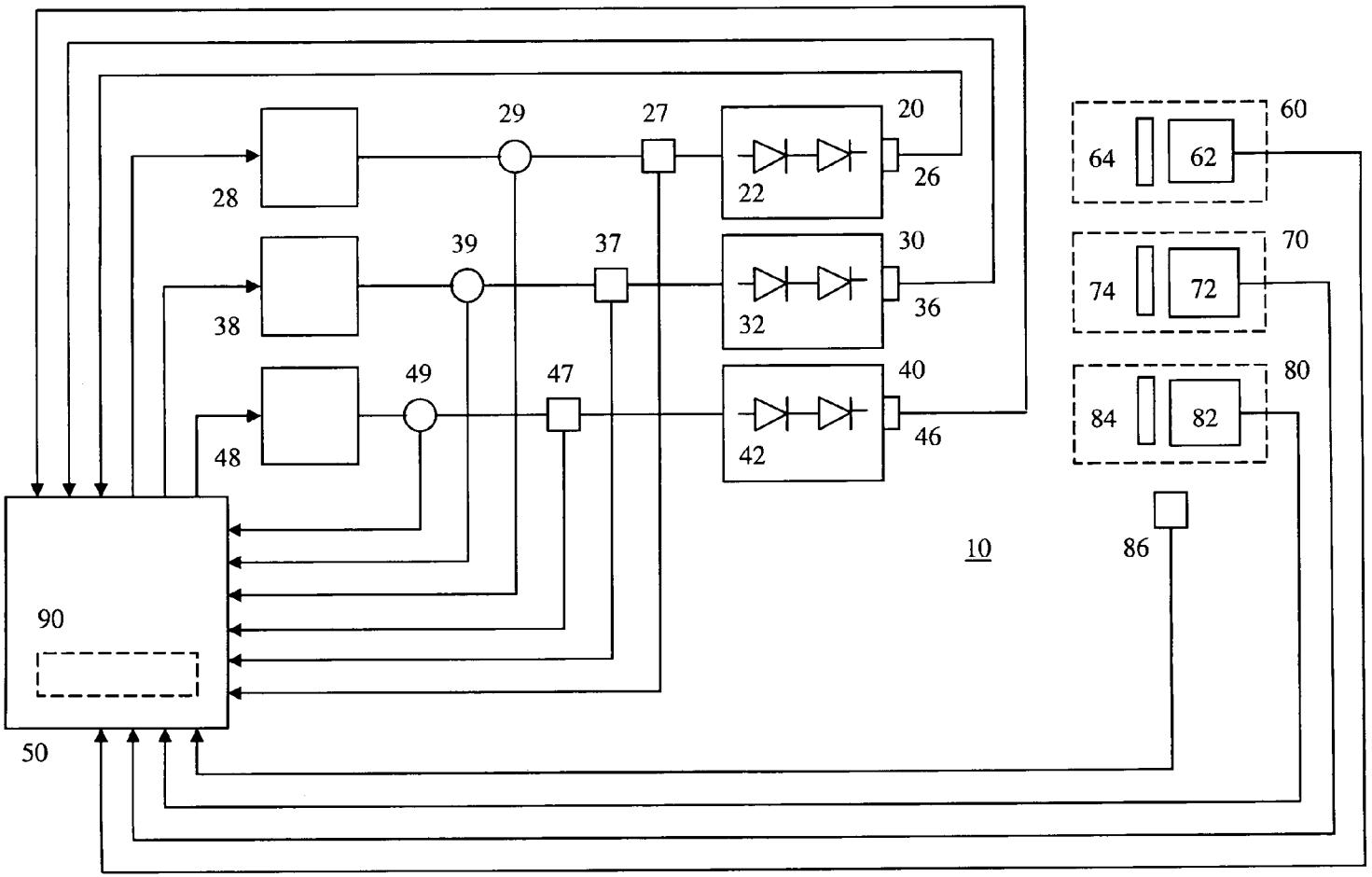
FIG. 1 is a block diagram of a light-emitting element luminaire according to one embodiment of the present invention.

The term "light-emitting element" is used to define any device that emits radiation in any region or combination of regions of the electromagnetic spectrum for example, the visible region, infrared and/or ultraviolet region, when activated by applying a potential difference across it or passing a current through it, for example. Therefore a light-emitting element can have monochromatic, quasimonochromatic, polychromatic or broadband spectral emission characteristics. Examples of light-emitting elements include semiconductor, organic, or polymer/polymeric light-emitting diodes, blue or UV pumped phosphor coated light-emitting diodes, optically pumped nanocrystal light-emitting diodes or any other similar light-emitting devices as would be readily understood by a worker skilled in the art. Furthermore, the term light-emitting element is used to define the specific device that emits the radiation, for example a LED die, and can equally be used to define a combination of the specific device that emits the radiation together with a housing or package within which the specific device or devices are placed.

The term "output light" is used to define electromagnetic radiation of a particular frequency or range of frequencies in any region of the electromagnetic spectrum for example, the visible, infrared and ultraviolet regions, or any combination of regions of the electromagnetic spectrum, generated by a one or more of light-emitting elements.

The term "luminous flux" is used to define the amount of light emitted by a light source according to standards of the Commission Internationale de l'Eclairage (CIE). Where the wavelength regime of interest includes infrared and/or ultraviolet wavelengths, the term "luminous flux" is used to include radiant flux as defined by CIE standards.

The term "spectral radiant flux" is used to define the quantity of radiant flux per unit wavelength at each wavelength emitted by a light source according to CIE standards.

The term "spectral power distribution" is used to refer to the wavelength dependency of the differential amount of radiant flux per differential wavelength within a region of interest of the electromagnetic spectrum.

The term "chromaticity" is used to define the perceived colour impression of light according to CIE standards.

The term "sensor" is used to define a device having a measurable sensor parameter in response to a physical quantity, including temperature, chromaticity or luminous flux.

The term "controller" is used to define a computing device or microcontroller having a central processing unit (CPU) and peripheral input/output devices (such as A/D or D/A converters) to monitor parameters from peripheral devices that are operatively coupled to the controller. These input/output devices can also permit the CPU to communicate and control peripheral devices that are operatively coupled to the controller. The controller can optionally include one or more storage media collectively referred to herein as "memory". The memory can be volatile and non-volatile computer memory such as RAM, PROM, EPROM, and EEPROM, floppy disks, compact disks, optical disks, magnetic tape, or the like, wherein control programs (such as software, microcode or firmware) for monitoring or controlling the devices coupled to the controller are stored and executed by the CPU. Optionally, the controller also provides the means of converting user-specified operating conditions into control signals to control the peripheral devices coupled to the controller. The controller can receive user-specified commands by way of a user interface, for example, a keyboard, a touchpad, a touch screen, a console, a visual or acoustic input device as is well known to those skilled in this art.

The term "substrate" is used to define a thermally conductive material with which a light-emitting element is in thermal contact and capable of transferring heat generated by the light-emitting element thereto.

As used herein, the term "about" refers to a +/−10% variation from the nominal value. It is to be understood that such a variation is always included in any given value provided herein, whether or not it is specifically identified.

Unless defined otherwise, all technical and scientific terms used herein have the same meaning as commonly understood by one of ordinary skill in the art to which this invention belongs.

The present invention provides and method and apparatus for compensating for chromaticity or CCT drift for multicolour light-emitting element-based luminaires irrespective of the luminous flux output. The luminous flux output of luminaires can be affected by changes in the spectral power distribution of the output light of the individual light-emitting elements in the luminaire due to variations in temperature, as for example caused by varying operating conditions, time-averaged or instantaneous peak current, and device aging. This effect can become problematic in feedback controlled light-emitting element-based luminaires, since the changes to the spectral power distribution of the output light can affect the sensor readings from the feedback sensors, which in turn can cause the feedback controller to enhance undesired effects of the drift. The present invention can alleviate these problems by considering one or more of the following: heat sink temperature, substrate temperature, instantaneous forward current and time-averaged forward current. Based on these parameters, as well as empirical characteristics of the sensors and the light-emitting elements, a feedback controller can make adjustments to drive currents in order to substantially maintain the output light of the luminaire at the desired chromaticity or CCT.

The present invention provides a luminaire system capable of generating light of a desired chromaticity and luminous flux output during continuous operation with varying ambient operating temperature. The luminaire system can be further capable of maintaining a desired correlated colour temperature during dimming of the luminaire. The luminaire system comprises one or more arrays of light-emitting elements for generating light. A current driver system is coupled to the arrays and can selectively supply electrical drive current to each of the arrays, wherein the current driver system is responsive to drive signals received from a controller. The luminaire system further comprises an optical sensor system which captures a predetermined portion of the generated light and generates optical signals representative of chromaticity and luminous flux output of the predetermined portion of the light. A heat sensing system is operatively coupled to the one or more arrays and provides a means for generating signals representative of the junction temperatures of arrays of light-emitting elements during operation. The luminaire system further comprises a controller that is operatively connected to the current driver system, the optical sensor system and the heat sensing system for receiving the signals generated by each of these systems. The controller is configured to generate one or more drive signals for transmission to the current driver system in response to the optical signals and thermal signals received from the optical system and the heat sensing system, respectively. The controller is thereby enabled to modify the light emitted by the arrays of light-emitting elements having specific regard to current light output, desired light output and the variations in light output from the arrays of light-emitting elements based on junction temperature thereof.

FIG. 1 illustrates a block diagram of a light-emitting element luminaire according to an embodiment of the present invention. The luminaire 10 includes arrays 20, 30, 40 each having a plurality of light-emitting elements that are in thermal contact with one or more heat sinks (not shown). In an embodiment of the invention, the red light-emitting elements 22, green light-emitting elements 32, and blue light-emitting elements 42 in arrays 20, 30, 40 can be mounted on separate heat sinks. The combination of coloured light generated by each of the red light-emitting elements 22, green light-emitting elements 32 and blue light-emitting elements 42 can. generate light of a specific chromaticity, for instance white light. In one embodiment, the luminaire 10 includes mixing optics (not shown) to spatially homogenize the output light generated by mixing light from the red light-emitting elements 22, green light-emitting elements 32, and blue light-emitting elements 42.

Current drivers 28, 38, 48 are coupled to arrays 20, 30, 40, respectively, and are configured to supply current to the red light-emitting elements 22, green light-emitting elements 32, and blue light-emitting elements 42 in arrays 20, 30, 40. The current drivers 28, 38, 48 control the luminous flux outputs of the red light-emitting elements 22, green light-emitting elements 32, and blue light-emitting elements 42 by regulating the flow of current through the red light-emitting elements 22, green light-emitting elements 32, and blue light-emitting elements 42. The current drivers 28, 38, 48 are configured to regulate the supply of current to arrays 20, 30, 40 independently so as to control the chromaticity of the combined light as described hereinafter.

In an embodiment of the present invention the current drivers 28, 38 and 48 can use the pulse width modulation (PWM) technique for controlling the luminous flux outputs of the red light-emitting elements 22, green light-emitting elements 32, and blue light-emitting elements 42. Since the average output current to the red light-emitting elements 22, green light-emitting elements 32, or blue light-emitting elements 42 is proportional to the duty factor of the PWM control signal, it is possible to dim the output light generated by the red light-emitting elements 22, green light-emitting elements 32, or blue light-emitting elements 42 by adjusting the duty factors for each array 20, 30 and 40, respectively. The frequency of the PWM control signal for the red light-emitting elements 22, green light-emitting elements 32, or blue light-emitting elements 42 can be chosen such that the human eye perceives the light output as being constant rather than a series of light pulses, for example a frequency greater than about 60 Hz for example. In an alternative embodiment, the current drivers 28, 38, 48 are controlled with pulse code modulation (PCM), or any other digital format as known in the art.

Current sensors 29, 39, 49 are coupled to the output of current drivers 28, 38, 48 and measure the instantaneous forward current supplied to the light-emitting element arrays 20, 30, 40. The current sensors 29, 39, 49 are optionally a fixed resistor, a variable resistor, an inductor, a Hall effect current sensor, or other element which has a known voltage-current relationship and can provide a measurement of the current flowing through the load, for example an array of one or more light-emitting elements, based on a measured voltage signal. In an alternative embodiment, the peak forward currents for each array 20, 30, or 40 can be fixed to a pre-set value to avoid measuring both the forward and instantaneous current supplied to arrays 20, 30, 40 at a given time.

A controller 50 is coupled to current drivers 28, 38, 48. The controller 50 is configured to independently adjust the amount of average forward current by adjusting the duty cycle of the current drivers 28, 38, 48, thereby providing control of the luminous flux output. The controller 50 can also be coupled to current sensors 29, 39, 49 and can be configured to monitor the instantaneous forward current supplied to the arrays 20, 30, 40 as provided by the current drivers 28, 38, 48.

In one embodiment, voltage sensors 27, 37, 47 are coupled to the output of current drivers 28, 38, 48 and measure the instantaneous forward voltage of light-emitting element arrays 20, 30, 40. Controller 50 is coupled to voltage sensors 27, 37, 47 and configured to monitor the instantaneous forward voltage of light-emitting element arrays 20, 30, 40. Because the junction temperature of a light-emitting element nonlinearly depends on the drive current, it is possible to determine the light-emitting element junction temperature by measuring the light-emitting element forward voltage, for example.

The luminaire 10 further includes optical sensor systems 60, 70, 80 which can be operatively coupled to a proportional-integral-derivative (PID) feedback loop configuration with PID controller 90 that can be embedded in controller 50 in firmware. Alternatively, the PID controller 90 can be a separate component operatively connected to the controller 50. A particular advantage of this configuration is that unlike the prior art, it is unnecessary to perform mathematical operations to convert between sets of tristimulus values. Consequently, the feedback loop can be implemented so as to have a fast response time that prevents the appearance of visual flicker, for example during dimming operations.

Each optical sensor system 60, 70, 80 generates a signal representative of the average spectral radiant flux from arrays 20, 30, 40. Each optical sensor system 60, 70, 80 includes, for example, optical sensors 62, 72, 82, which can be for example a photodiode, responsive to spectral radiant flux emitted by the arrays 20, 30, 40. In one embodiment, each optical sensor 62, 72, 82 can be configured to be sensitive to light of a narrow wavelength regime. Advantageously, red, green and blue optical sensors 62, 72, 82 can be used to measure the contribution from red light-emitting elements 22, green light-emitting elements 32 and blue light-emitting elements 42, respectively.

Since it is often desirable to detect the luminous flux output from the luminaire in a manner similar to that perceived by the human eye, in one embodiment the optical sensor systems 60, 70, 80 can be configured to provide an indication of the total luminous flux rather than the average spectral radiant flux output of the light emitted by arrays 20, 30, 40. Accordingly, each optical sensor 62, 72, 82 may be equipped with a filter 64, 74, 84 that can approximate, for example, the CIE V-lambda response of the human eye to the spectral power distribution of the output light. The optical signals representative of the spectral power distribution of the output light can be optically pre-processed with optical filters 64, 74, 84, or electronically pre-processed with pre-amplifier circuitry in the optical sensor system or can be processed by analog or digital means in the controller 50. The optical filters 64, 74, and 84 can be thin film interference, dyed plastic, dyed glass or the like. It is understood that a number of types of optical sensors can be used, for example photodiodes, phototransistors, photosensor integrated circuits (ICs), unenergized LEDs, and the like.

Variations in the ambient operating temperature can affect the output signal of optical sensor systems 60, 70, 80. For example, when the operating temperatures of optical sensors 62, 72, 82 deviate from their nominal values, the respective sensor signals can change, even when light with the same luminous flux and spectral power distribution is measured. In one embodiment the luminaire comprises a temperature sensor 86 for sensing the operating temperature of the optical sensor systems 60, 70 and 80. In one embodiment of the present invention the temperature dependence of the sensitivity of each optical sensor 62, 72, 82 is approximated in a first-order polynomial equation using coefficients suitable for a linear approximation which can be used to correct for the effects of temperature dependence of the optical sensor readings and to obtain a more accurate indication of the output light of the arrays 20, 30, 40. A polynomial-based correction can be implemented in controller 50 which can be configured with the polynomial coefficients to process the optical signals and compensate the respective drive currents for varying temperature operating conditions of the optical sensors 62, 72, 82. Evaluation of the polynomial equation can be performed by for example floating-point or fixed-point calculations or indexing of a lookup table.

In one embodiment, higher-order polynomial equations can be used to model the parametric temperature dependency of the optical sensors as would be readily understood by those skilled in the art. Evaluation of the polynomial equations can be performed by the controller 50. To calibrate the luminaire control system, for example the controller, the equation coefficients can be determined by computer simulation of a model luminaire or by experimental acquisition of empirical data of a luminaire and subsequently stored in memory of the controller 50. Alternatively, the equation can be pre-calculated and the results stored in a look-up table in the memory of the controller 50. The coefficients can be different for each optical sensor system 60, 70, 80. Furthermore, the temperature dependencies of the optical sensors 62, 72, 82 may not be the same for all wavelengths. These temperature dependencies can be governed by the material properties of the optical sensor 62, 72, 82 and any optional filters 64, 74, 84. For example, a photodiode with a red filter will have different temperature dependency than a photodiode with a green filter. For example, the sensitivity of silicon photodiodes to temperature variations in the red region of the visible spectrum is usually more pronounced than it is in the green region. Therefore, equation coefficients expressing temperature dependency for the red-filtered photodiode can be different from those for a green-filtered photodiode. The coefficients can be related to the inherent characteristics of the optical sensor 62, 72, 82 and may vary between different types of sensors.

Figure 2:
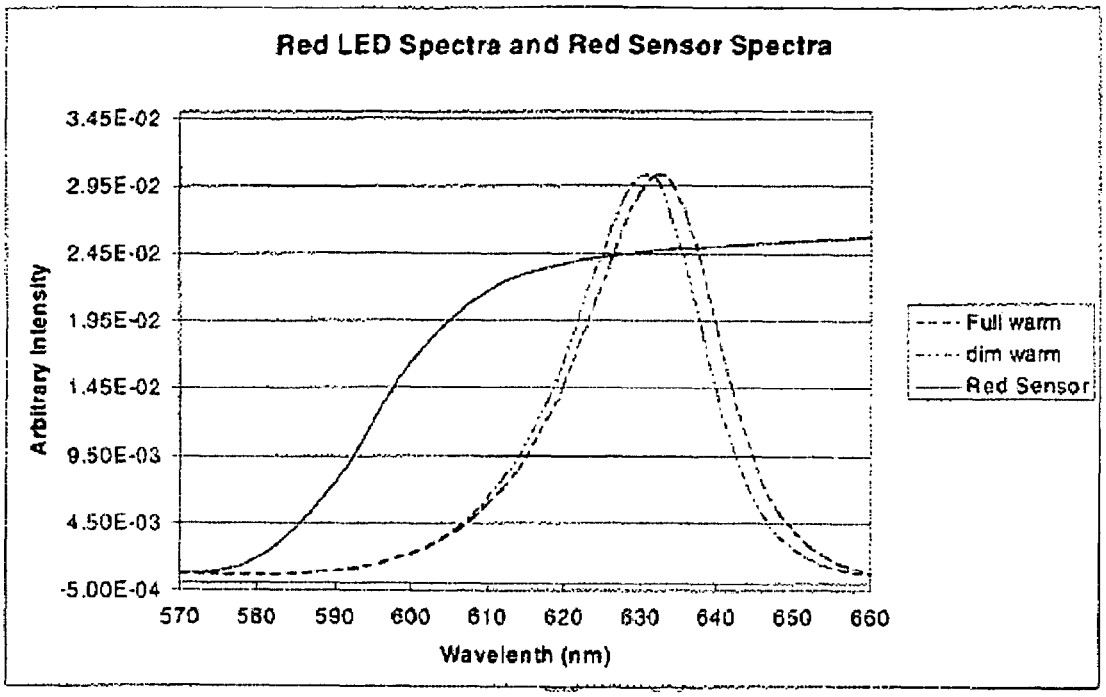
FIG. 2 is a graphical representation showing the red LED spectra during full light output and during reduced light output in relation to the spectral radiant flux response of a red sensor.

Ideal filters can completely suppress the transmission of light outside a certain wavelength regime while not attenuating transmitted light of wavelengths within this regime. However, physically-realizable optical filters 64, 74, 84 cannot perfectly filter light. Consequently, non-ideal filter characteristics of filters 64, 74, 84, if not compensated, can cause systematic errors in the luminaire control system, for example the controller. FIG. 2 illustrates the optical response of a red LED photodiode having a filter. As shown, the spectral power distribution of the red light generated by red LEDs can change during dimming. Due to the wavelength-dependent transmittance of the red filter, the output of the optical sensor will change, even though the integrated spectral radiant flux of the red light remains constant. In addition, the optical sensors 62, 72, 82 may have wavelength-dependent spectral responsivities, and the responsivity of the human eye varies with wavelength as determined by the CIE V-lambda response. Therefore in one embodiment, the equation coefficients as described above can vary as a function of luminous flux generated by red light-emitting elements as a consequence of the non-ideal characteristics of the physical filters 64, 74, 84. It is understood that this effect can also occur in other colours of light-emitting elements and may result in modification of the equation coefficients.

Another concern in maintaining constant luminous flux and chromaticity of the output light is the peak wavelength shift caused by variations in the junction temperature of the red light-emitting elements 22, green light-emitting elements 32 and blue light-emitting elements 42. This effect is exemplified in FIG. 2, which illustrates that there is a shift in spectral power distributions of the red light generated by a red LED between full intensity and dimmed operation, which corresponds to a change in luminous flux output. As the junction temperature increases, the peak wavelength of the luminous flux emitted by a light-emitting element can shift. In consequence, the shift in the peak wavelength due to junction temperature variations can be different for each of the red light-emitting elements 22, green light-emitting elements 32, and blue light-emitting elements 42. For instance, it is known that light generated by red LEDs undergoes the largest temperature dependent peak wavelength shift at about 0.15 nm per degree Celsius, while light emitted by green LEDs or blue LEDs shifts significantly less under the same thermal operating conditions. In addition, the luminous flux output of red LEDs based on AlInGaP technology is nonlinearly dependent on the junction temperature, while the luminous flux output of green and blue LEDs based on InGaN technology is linearly dependent. As a result, the junction temperature of the red light-emitting elements 22, green light-emitting elements 32 and blue light-emitting elements 42 can be monitored, constantly or at a predetermined or varying interval and a shift in the peak wavelengths of the emitted light can be accounted for by adjusting the target optical sensor response values to maintain the desired chromaticity or CCT of the combined light, independent of whether the luminous flux output is constant or varying due to dimming. In one embodiment each equation coefficient can account for the foregoing effects and can be expressed as a function of measured input variables such as temperature, spectral radiant flux, and luminous flux output, for example.

One or more temperature sensors 26, 36, 46 in thermal contact with the one or more heat sinks, and coupled to controller 50 can be provided to measure the temperature of the arrays 20, 30, 40. The temperature of the arrays 20, 30, 40 can be correlated to the junction temperature of red light-emitting elements 22, green light-emitting elements 32 and blue light-emitting elements 42. In the presently described embodiment, junction temperature of the red light-emitting elements 22, green light-emitting elements 32 and blue light-emitting elements 42 is estimated by interpolation based on a thermal model of the light-emitting element. The thermal behaviour of the light-emitting element can be dependent upon the inherent characteristics of the particular light-emitting element employed, such as the material used, size, packaging, etc. Consequently, in one embodiment the equation coefficients can functionally depend on the junction temperatures for the red light-emitting elements 22, green light-emitting elements 32 and blue light-emitting elements 42. The polynomial-based correction can be implemented in the controller 50 to account for the junction temperature. The temperature dependence of the equation coefficients can be determined based on mathematical interpolation of the junction temperatures of the red light-emitting elements 22, green light-emitting elements 32 and blue light-emitting elements 42, or by other similar methods otherwise known in the art.

In one embodiment, red light-emitting elements 22, green light-emitting elements 32, and blue light-emitting elements 42 can be mounted on separate heat sinks with separate temperature sensors thermally connected thereto. It is understood that the red light-emitting elements 22, green light-emitting elements 32, and blue light-emitting elements 42 can also be mounted on a single heat sink, whereby at least one temperature sensor would be needed to determine the junction temperature of the red light-emitting elements 22, green light-emitting elements 32, and blue light-emitting elements 42. In another embodiment of the present invention, the temperature sensors 26, 36, 46 are placed proximate to each light-emitting element array 20, 30, or 40 to provide a more accurate value of the junction temperature of the red light-emitting elements 22, green light-emitting elements 32 and blue light-emitting elements 42, respectively. It is noted that the red light-emitting elements 22, green light-emitting elements 32 and blue light-emitting elements 42 are likely pulsed at a rate much higher than the thermal time constant of the one or more heat sinks and therefore the temperature sensor 26, 36, 46 will therefore likely observe an average heat load.

In one embodiment temperature sensors 26, 36, 46 can be implemented using a thermistor, thermocouple, light-emitting element forward voltage measurement, integrated temperature sensing circuits, or any other device or method that is responsive to variations in temperature as contemplated by those skilled in the art.

In one embodiment of the present invention, voltage sensors 27, 37, 47 are coupled to controller 50 to measure the forward voltage of the arrays 20, 30, 40. The forward voltage of the arrays 20, 30, 40 can be correlated to the junction temperature of red light-emitting elements 22, green light-emitting elements 32 and blue light-emitting elements 42. The equation coefficients can functionally depend on the forward voltage or the estimated values of the junction temperatures for the red light-emitting elements 22, green light-emitting elements 32 and blue light-emitting elements 42 and implemented in the controller 50 to monitor junction temperature variations.

It has been observed that the amount of forward current supplied to the arrays 20, 30, 40 can cause variations in junction temperature beyond what may be measured at the one or more heat sinks and in turn can cause shifting in the peak wavelength of light generated by the red light-emitting elements 22, green light-emitting elements 32 and blue light-emitting elements 42. The effect of the forward current can become an important consideration in luminaires using PWM or PCM to control the luminous flux output. For example, in order to reduce the effect of the forward current-induced wavelength variations, the instantaneous forward current of the red light-emitting elements 22, green light-emitting elements 32 and blue light-emitting elements 42 can be kept at a constant level during the ON cycle. However, as the duty cycle and the average forward current are varied, the difference between the junction temperature of the red light-emitting elements 22, green light-emitting elements 32 and blue light-emitting elements 42 and the temperature at the one or more heat sinks increases with increasing duty cycle. As a result, the temperature measured by the one or more heat sinks by temperature sensors 26, 36, 46 may not reflect the junction temperature of the red light-emitting elements 22, green light-emitting elements 32 and blue light-emitting elements 42. The temperatures at one or more heat sinks may remain relatively constant due to the longer thermal time constant of a heat sink, while the junction temperatures of the red light-emitting elements 22, green light-emitting elements 32 and blue light-emitting elements 42 will typically change in relation to variations in the forward current. More generally, any sudden change in forward current will cause a sudden change in the temperature of the light-emitting element junction that will exponentially equilibrate to a new steady-state temperature as the light-emitting element substrate, package, and heat sink approach thermal equilibrium, for example.

This junction temperature change of the red light-emitting elements 22, green light-emitting elements 32 and blue light-emitting elements 42 can cause a spectral shift in the peak wavelength of light generated by each of the red light-emitting elements 22, green light-emitting elements 32 and blue light-emitting elements 42 which may not be accounted for by temperature sensors 26, 36, 46 when measuring the temperature of the one or more heat sinks. In one embodiment, to compensate for the undesirable shift due to average forward current, another polynomial-based correction relating to peak wavelength shift due to variations in the average forward current can be derived during calibration of the luminaire 10. This polynomial-based correction can be used by the controller 50 to compensate for wavelength deviations when varying the duty cycle and subsequently the average forward current to current drivers 28, 38, 48.

In one embodiment, a polynomial-based correction relating to peak wavelength shift due to variations in the average forward current can be determined by measuring the spectral radiant flux output at luminaire 10 at full luminous flux output, and subsequent measurements of the spectral radiant flux output with the luminaire 10 dimmed to one or more levels. The target optical sensor response level can be adjusted with a polynomial-based correction for each colour from the red light-emitting elements 22, green light-emitting elements 32 and blue light-emitting elements 42 to ensure that the combined light output has the same desired chromaticity. Alternatively, equation coefficients can optionally be derived from empirical data.

In another embodiment, the junction temperature for each array 20, 30, 40 can be determined from the sum of the measured heat sink temperature and the derived difference between the heat sink temperature and the junction temperature. The difference can be calculated if the thermal resistance (° C./W) is known and constant based on the amount of electrical power delivered to each array. The light-emitting element arrays 20, 30, 40 convert the electrical power into two parts; emitted luminous flux and heat. The heat dissipated by the arrays is known as the "heat load," and is measured in watts. The junction temperature difference can be calculated using the following:

$$\Delta T = \theta_R * Q \quad (1)$$

where: ΔT is the temperature difference between the heat sink and junction in ° C.; $\theta_R$ is the thermal resistance (° C./W); and Q is the heat load (W). This factor can then be calculated by controller 50 to compensate for peak wavelength shift due to junction temperature instead of two separate factors based on the heat sink temperatures and forward current.

In another embodiment the junction temperature for each array 20, 30, 40 can be determined from the heat sink temperature and the heat load which can be derived from the average forward currents. The difference between the heat sink temperatures and the respective junction temperatures can be determined if the thermal resistance (° C./W) between the junction and the heat sink is known and is temperature independent. Based on this information and the power dissipation in the light-emitting element array 20, 30, 40, the junction temperature for the red light-emitting elements 22, green light-emitting elements 32 and blue light-emitting elements 42 can therefore be determined. A corresponding polynomial-based correction can then determined by controller 50 to compensate for peak wavelength shift due to junction temperature instead of two separate polynomial-based temperature corrections, one relating to heat sink temperature and the other to forward current.

In another embodiment of the invention, the junction temperature for each array 20, 30, 40 can be determined from the forward voltage as measured by voltage sensor 27, 37, 47. A corresponding polynomial-based correction can implemented by controller 50 to compensate for peak wavelength shift due to junction temperature.

Figure 3:
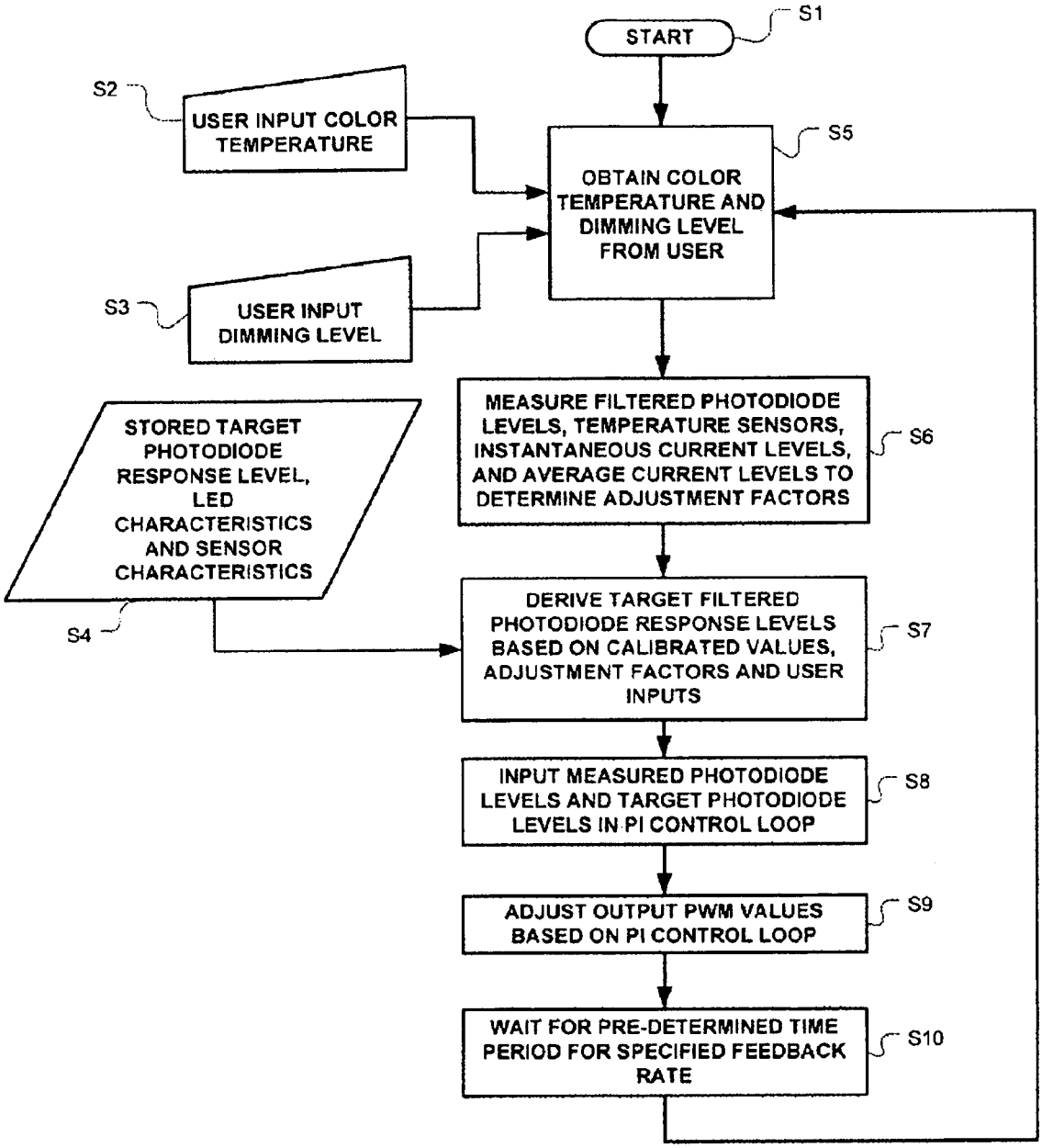
FIG. 3 is a flow chart showing the sequence of steps involved in the control process of a controller according to an embodiment of the present invention.

Reference is now made to FIG. 3, which shows a sequence of steps for the control process performed by the controller 50 in accordance with one embodiment of the present invention. Once the luminaire 10 is turned on in Step S1, the user preference for colour temperature or more generally chromaticity and luminous flux output or dimming level are input to controller 50 in Step S2 and Step S3, respectively. Information relating to characteristics of the red light-emitting elements 22, green light-emitting elements 32 and blue light-emitting elements 42, characteristics of temperature sensors 26, 36, 46 and optical sensors 62, 72, 82 are stored in the controller 50 at Step S4 either at startup or during calibration. At Step S5, the controller 50 obtains the colour temperature and dimming level input by the user in Steps S2 and S3.

During Step S6, the controller 50 monitors and obtains the spectral radiant flux measured by optical sensors 62, 72, 82 with filters 64, 74, 84, the junction temperature measured by the temperature sensors 26, 36, 46 or voltage sensors 27, 37, 47, and the instantaneous and average forward current supplied by current drivers 28, 38, 48 to the arrays 20, 30, 40 as sensed by the current sensors 29, 39, 49, and determines the polynomial-based correction. On the basis of this information and the calibration data from Step S4, the polynomial-based correction and the user inputs, the controller determines in Step S7 the target response for the optical sensors 62, 72, 82.

Once the target response for the optical sensors 62, 72, 82 has been determined, in Step S8, the target optical sensor response levels are communicated to the PID controller 90 in the PID loop configuration with controller 50. The error inputs to the PID loop are based on target and measured optical sensor responses. At Step S9, the controller 50 adjusts the duty cycle of the PWM control signal for current drivers 28, 38, 48 based on values from PID controller 50. In Step 9. The controller 50 waits for a predetermined time in order to allow the feedback loop to make the appropriate adjustments, then returns to Step S5.

It is obvious that the foregoing embodiments of the invention are exemplary and can be varied in many ways. Such present or future variations are not to be regarded as a departure from the spirit and scope of the invention, and all such modifications as would be obvious to one skilled in the art are intended to be included within the scope of the following claims.

We claim:

1. A luminaire system for generating light of a desired chromaticity and luminous flux output, the luminaire system comprising:

(a) one or more arrays, each array comprising one or more light-emitting elements for generating light;

(b) a current driver system operatively coupled to the one or more arrays, the current driver system for selectively supplying electrical drive current to each of the one or more arrays, the current driver system being responsive to one or more drive signals;

(c) one or more optical sensor systems operatively coupled to the one or more light-emitting elements, each optical sensor system comprising one or more optical sensors for sensing a predetermined portion of the light generated by the light-emitting elements, each optical sensor system configured to generate optical signals representative of chromaticity and luminous flux output of the predetermined portion of the light;

(d) a heat sensing system operatively coupled to the one or more arrays, the heat sensing system comprising one or more thermal sensors for generating first signals representative of junction temperatures of each of the one or more arrays, at least one thermal sensor positioned proximate to each of the one or more arrays; and (e) a controller operatively connected to the current driver system, the one or more optical sensor systems and the heat sensing system; the controller being configured to generate one or more drive signals in response to the optical signals relative to the desired chromaticity and luminous flux output, the controller further configured to modify the one or more drive signals in response to the first signals thereby compensating for temperature variations of the arrays;

wherein the luminaire system is adapted for connection to a source of power.

2. The luminaire system according to claim 1, further comprising a current sensor system operatively coupled to the current driver system, the current sensor system for generating second signals representative of the electrical drive current supplied to each of the one or more arrays and the controller being further configured to modify the one or more drive signals in response to the second signals.

3. The luminaire system according to claim 1, wherein the heat sensing system is further operatively coupled to the one or more optical sensor systems, the heat sensing system further generating third signals representative of operational temperature of the one or more optical sensor systems and the controller being further configured to modify the one or more drive signals in response to the third signals.

4. The luminaire system according to claim 1, wherein one or more of the optical sensor systems further comprises an optical filter optically coupled to one of the optical sensors.

5. The luminaire system according to claim 4, wherein the optical filter has predetermined filter characteristics.

6. The luminaire system according to claim 4, wherein the optical filter has controllable filter characteristics.

7. The luminaire system according to claim 1, wherein the heat sensing system further comprises a voltage sensing system including one or more voltage sensors for generating fourth signals representative of forward voltage to one or more of the arrays and the controller being further configured to modify the one or more drive signals in response to the fourth signals.

8. The luminaire system according to claim 1, wherein the controller is configured to evaluate one or more polynomial equations defining relationships between junction temperature and light emission characteristics of the one or more light-emitting elements for determination of the one or more drive signals.

9. The luminaire system according to claim 3, wherein the controller is configured to evaluate one or more polynomial equations defining relationships between temperature and optical signals from the one or more optical sensor systems for determination of the one or more drive signals.

10. The luminaire system according to claim 7, wherein the controller is further configured to correlate forward voltage with junction temperature of the one or more light-emitting elements and the controller is configured to evaluate one or more polynomial equations defining relationships between junction temperature and light emission characteristics of the one or more light-emitting elements for determination of the one or more drive signals.

11. The luminaire system according to claim 3, wherein the controller is configured to use a look-up table to compensate for varying operating temperature conditions of the one or more optical sensors.

12. The luminaire system according to claim 1, wherein each array is mounted on a different heat sink.

13. The luminaire system according to claim 1, wherein the one or more arrays are mounted on one heat sink.

14. The luminaire system according to claim 1, wherein the one or more thermal sensors are selected from the group comprising thermistor, thermocouple and an integrated temperature sensing circuit.

15. The luminaire system according to claim 2, wherein the second signals are indicative of instantaneous electrical drive current.

16. The luminaire system according to claim 2, wherein the second signals are indicative of time-averaged electrical drive current.

17. The luminaire system according to claim 1 comprising a plurality of light-emitting elements, wherein at least one light-emitting element emits red light, at least one light-emitting element emits green light and at least one light-emitting element emits blue light.

18. The luminaire system according to claim 1, wherein the one or more drive signals are configured as pulse width modulation signals or pulse code modulation signals.

19. The luminaire system according to claim 18, wherein the one or more drive signals are modulated at a frequency greater than 60 Hz.

20. The luminaire system according to claim 1, wherein the controller is a proportional-integral-derivative controller.

21. The luminaire system according to claim 1, wherein at least one of the one or more optical sensors is configured having a narrow wavelength sensitivity.

22. The luminaire system according to claim 4, wherein the optical filter is configured to approximate CIE V-lambda response of a human eye.

23. The luminaire system according to claim 4, wherein the optical filter is a thin film interference filter or a dyed plastic filter or a dyed glass filter.

24. The luminaire system according to claim 1, wherein the one or more optical sensor system comprise pre-amplification circuitry to process the optical signals.

25. The luminaire system according to claim 1, wherein the one or more optical sensors are selected from the group comprising photodiode, phototransistor, photosensor integrated circuit and unenergized LED.

26. In a luminaire system a method for controlling operation of light-emitting elements to generate light having a desired chromaticity and luminous flux output, the method comprising the steps of:

(a) providing drive currents to the light-emitting elements for generation of light;

(b) measuring optical signals representative of the light being generated by a optical sensing system;

(c) measuring temperature signals representative of junction temperature of the light-emitting elements;

(d) evaluating a first modification factor defined by a relationship between junction temperature and light emission characteristics of the light-emitting elements;

(e) determining new drive currents based on the measured optical signals, the desired chromaticity and luminous flux output and the first modification factor;

(f) providing the new drive currents to the light-emitting elements; thereby controlling the operation of the light-emitting elements to generate light having the desired chromaticity and luminous flux output.

27. The method according to claim 26, wherein after step c) performing the steps of:

(a) measuring temperature signals representative of operational temperature of the optical sensing system; and (b) evaluating a second modification factor defined by a relationship between operational temperature and optical signals from the optical sensor system; wherein the step of determining new drive currents is further based on the second modification factor.

28. The method according to claim 26, wherein after step c) performing the steps of:

(a) measuring forward voltage signals representative of the drive currents to the light-emitting elements;

(b) evaluating second junction temperatures of the light-emitting elements based on the forward voltage signals;

(c) evaluating a third modification factor defined by a relationship between second junction temperatures and light emission characteristics of the light-emitting elements;

wherein the step of determining new drive currents is further based on the third modification factor.

29. The method according to claim 26, wherein after step a) performing the step of measuring current signals representative of the electrical current supplied to the light-emitting elements, wherein the step of determining new drive currents is further based on the measured current signals.

* * * * *